US007607989B2

(12) United States Patent
Hess et al.

(10) Patent No.: US 7,607,989 B2
(45) Date of Patent: Oct. 27, 2009

(54) SYSTEMS OF SPORT PERFORMANCE ENHANCEMENT AND MARKETING

(75) Inventors: Keith E. Hess, Fort Collins, CO (US); Sheralyn D. Hess, Fort Collins, CO (US)

(73) Assignee: Santangelo Capital Investments, LLC, Fort Collins, CO (US)

( * ) Notice: Subject to any disclaimer, the term of this patent is extended or adjusted under 35 U.S.C. 154(b) by 931 days.

(21) Appl. No.: 10/199,194

(22) Filed: Jul. 19, 2002

(65) Prior Publication Data

US 2003/0207722 A1 Nov. 6, 2003

Related U.S. Application Data

(60) Provisional application No. 60/377,676, filed on May 3, 2002.

(51) Int. Cl.
*A63B 53/00* (2006.01)

(52) U.S. Cl. ..... 473/282

(58) Field of Classification Search ..... 473/324, 473/345, 344, 409, 331; 600/547
See application file for complete search history.

(56) References Cited

U.S. PATENT DOCUMENTS

| | | | | |
|---|---|---|---|---|
| 3,655,202 A | | 4/1972 | Gautraud et al. | 273/176 FA |
| 3,969,264 A | | 7/1976 | Davis | 252/299 |
| 4,022,706 A | | 5/1977 | Davis | 252/299 |
| 4,278,095 A | | 7/1981 | Lapeyre | 128/689 |
| 4,751,642 A | | 6/1988 | Silva et al. | 364/413 |
| 4,962,931 A | * | 10/1990 | Jazdzyk, Jr. | 473/252 |
| 5,104,457 A | * | 4/1992 | Viljoen et al. | 473/350 |
| 5,302,440 A | | 4/1994 | Davis | 428/196 |
| 5,324,031 A | * | 6/1994 | Green | 473/252 |
| 5,337,670 A | | 8/1994 | Huang | 101/487 |
| 5,342,054 A | | 8/1994 | Chang et al. | 273/186.1 |

(Continued)

FOREIGN PATENT DOCUMENTS

GB 2335149 9/1999

(Continued)

OTHER PUBLICATIONS

"Hidden Design Dimensions", Swingweight.com, http://www.swingweight.com/hidden_dimensions.htm, published May 1, 2000, Hidden Dimension pp. 1-4, Hidden Dimensions Part 2, pp. 1-4.*

(Continued)

*Primary Examiner*—Tom Duong
(74) *Attorney, Agent, or Firm*—Santangelo Law Offices, P.C.

(57) ABSTRACT

Systems of affecting sports performance are disclosed that provide sensory stimulation and induce a response, such as a psychological or physiologic response, including performance enhancement through sports equipment configuration. Equipment configuration may include sensory stimulation configurations, such as color, image, business designation, or other indicia, provided to sports equipment, potentially through paint processes, and may utilize color psychology to make color or other customized visual, psychological, or physiological dependent choices, creating indicia to produce consistent performance, a vehicle for self-expression, or brand awareness. Marketing systems are further disclosed incorporating indicia configured to sports equipment, such as golf clubs, serving as custom expressive indicia. Further, systems are disclosed that assist consumers in making configuration determinations and purchases employing any or all of the above elements.

7 Claims, 8 Drawing Sheets
(3 of 8 Drawing Sheet(s) Filed in Color)

U.S. PATENT DOCUMENTS

| | | | | |
|---|---|---|---|---|
| 5,542,680 | A * | 8/1996 | Proudfit et al. | 473/378 |
| 5,778,793 | A * | 7/1998 | Mello et al. | 101/494 |
| 5,800,285 | A | 9/1998 | Thorne et al. | 473/324 |
| 5,805,245 | A | 9/1998 | Davis | 349/20 |
| 5,890,906 | A | 4/1999 | Macri et al. | 434/247 |
| 6,067,468 | A | 5/2000 | Korenman et al. | 600/547 |
| 2002/0032073 | A1 | 3/2002 | Rogers et al. | 473/324 |

FOREIGN PATENT DOCUMENTS

WO WO 01/28640 A1 4/2001

OTHER PUBLICATIONS

"Golf Clubs", USA Graphics, http://www.freethrowmaster.com/Usagraphics/Gallery/Golf_Clubs/info/info.html, printed Aug. 26, 2002, 2 pages.

"Golf Clubs Pricing Information", USA Graphics, http://www.freethrowmaster.com/Usagraphics/Gallery/Golf_Clubs/golf_clubs.html, printed Aug. 26, 2002, 2 pages.

"Corporate Examples", Insane Graphics, http://www.insanedesigns.net/FRAMEPAGE.htm, printed Aug. 26, 2002, 1 page.

"Clubmaking Tips with F. Jack Mayes", Golf Coffee, http://www.golfcoffee.com/Clubmaking%20Tips.htm, printed Aug. 26, 2002, 3 pages.

"Custom Made Golf Club Sets", Golf Coffee, http://www.golfcoffee.com/f_jack_mayes.htm, printed Aug. 26, 2002, 2 pages.

"Custom Fitting Chart", F-Jacks Golf and Taxidermy Shoppe, http://www.golfcoffee.com/custom_fitting_chart.htm, printed Aug. 26, 2002, 3 pages.

"Custom Hand Painted Golf Clubs and Shafts", Golf Pro Help, http://www.golfprohelp.com/Press_Releases/2002_June/golf_club.asp, printed Aug. 26, 2002, 2 pages.

"Cleaveland Golf—Equipment—Irons", http://www.cleavelandgolf.com/proshop/irons/ta.5.html, printed Jun. 26, 2002, 2 pages.

* cited by examiner

2G

SYSTEMS OF SPORT PERFORMANCE ENHANCEMENT AND MARKETING

CROSS-REFERENCE TO RELATED APPLICATIONS

The present application claims the benefit of U.S. provisional application No. 60/377,676, filed May 3, 2002, hereby incorporated by reference.

FIELD OF THE INVENTION

The present invention is directed to the fields of sports, performance enhancement, and marketing, generally. The present invention is applicable in affecting sports performance, systems of performance enhancement, marketing systems, and sports equipment customization and configuration. Embodiments of the present invention may be especially applicable for the inducement of a response, such as a psychological or physiologic response, to provide performance enhancement through sports equipment configuration, and in some embodiments, as a marketing system.

BACKGROUND OF THE INVENTION

The use and effects of color and imagery on emotion and mood may have been considered in a variety of fields for many years. For example, a "green room" is often provided for guests prior to a television appearance in an attempt to calm the guest. As a further example, and with regard to athletic sport facilities, the locker room for the opposing team may be painted pink in an general attempt to make the team more subdued. A further example might include the usage of dark colored jerseys, such as the dark uniforms of the Oakland Raiders™ football team, which may be utilized in a general attempt to bolster the team's aggressiveness and in hopes of frightening the opposing team.

Sports, in particular, often incorporate various psychologic and physiologic aspects that individually affect participant performance, such as an individual's ability to focus on the particular action or function required during participation in the sport. The participant's psychologic and physiologic state may ultimately affect the participant's performance and the outcome of the athletic event. In golf, for example, the individual must concentrate on striking a small ball with a club, swinging with sufficient force to allow satisfactory advancement of the ball, while maintaining a consistent swing of the club to allow for sufficient force to be applied and to provide sufficient control over ball trajectory. It is generally considered that many of the above factors regarding the club swing may be affected to a large extent by the participant's psychologic and physiologic state prior to and during performance of the sport, especially during the club swing, and the effect such state has on performance.

Sports equipment manufactures, such as golf club manufactures, have provided various finishes to their clubs. One significant problem is that while there are different finishes on sports equipment, the finishes do not address the psychological or physiological state of the individual as previously mentioned, especially during performance. For example, there are painting techniques used on golf clubs as those disclosed in U.S. Pat. No. 4,022,706 (and subsequent U.S. Pat. No. 5,805,245) that use thermochromic liquid crystals that will allow the golfer to see where on the club head the ball is struck using the heat produced at the point of impact. Furthermore, there are techniques such as those disclosed in U.S. Publication No. 2002/0032073 (U.S. application Ser. No. 09/246,976) to apply durable finishes into which limited colors can be added to create a diamond-like carbon decorative coating for metals. While such methods may give feedback after the ball is hit, or may provide durability and limited color options, respectively, these processes do not affect or enhance the performance of the participant by particularly addressing the individual's psychologic or physiologic state, especially during the performance of a sport such as golf, or induce a response that affects or enhances performance, especially prior to or during play.

One golf club manufacture provides a particular finish to the club head of the club, in an attempt to help the individual frame the ball with the club head at address. The finish of the club, referred to as a GunMetal™ finish, is provided on the club head, as shown and described in the heretofore cited website reference and as provided by Cleveland Golf™. Although the attempt appears to be directed to the mechanical aspect of using the club, the finish does not address the individual's psychologic or physiologic state, does not affect or enhance the performance of the participant relative to such psychologic or physiologic state, especially during the performance of the sport, and is not directed to the inducement of a response that affects or enhances performance, especially prior to or during play.

Again, using golf as but one example, there are techniques to apply printing on the head of the golf club, such as disclosed in U.S. Pat. No. 5,337,670, and techniques to etch the metal surfaces of the golf club after fabrication, such as disclosed in U.S. Pat. No. 5,800,285, but again, neither of these processes address the psychological or physiological state of the individual, does not affect or enhance the performance of the participant relative to such psychologic or physiologic state, especially during the performance of the sport, and is not directed to the inducement of a response that affects or enhances performance, especially prior to or during play. The techniques also may not address aspects of color or imagery as performance enhancements.

A recognized need exists, therefore, in sports, such as golf, to address the psychologic and physiologic aspects that affect individual participant performance, especially during the performance of the sport. There has always been the desire to improve individual performance in sports, particularly individual performance during participation. However, there has been no satisfactory mode of affecting or enhancing the performance of the participant, or of inducing enhancement, particularly addressing the individual's psychologic or physiologic state, especially during the performance of a sport such as golf. Therefore, an unmet need exists for techniques that address the psychologic or physiologic state of the individual, especially during the performance of the sport, and the inducement of a response that affects or enhances performance, especially prior to or during play.

Furthermore, the use and effects of color and imagery for marketing purposes may have been considered in a variety of fields for many years. In sports and the sports equipment industry, insignias, colors, images, and other indicia have been used to designate the manufacturer of the equipment, the team or individual utilizing the equipment, and sponsors of the event, team or individual. One example of such use of color or imagery may include the jerseys supplied to professional athletic teams, such as the Denver Broncos™, or vehicles utilized in NASCAR™ events.

Individuals or groups may have utilized the sports equipment in an attempt to market goods or services or the source thereof, potentially, but not necessarily, related to the use of or association with the equipment or the team or individual utilizing the equipment. One example are the decals or other insignias applied to vehicles utilized in NASCAR™ events, as previously mentioned, designating the sponsors, the vehicle, the driver, and the race team.

In golf, clubs and other golf equipment may be manufactured and configured having etching, stickers, paint, or the like, as previously described, that designate the manufacturer, that have mechanical function, such as color or etching to line up a club head to the golf ball and to frame the ball at address, or that provide a limited color selection for the general populous of consumers. The etching, stickers, paint, or the like, may correspond with a trademark or trade dress of the manufacturer or representative of the manufacturer. However, such etching, stickers, paint, or the like of clubs or other golf equipment do not provide satisfactory indicia to designate other goods, sources or services, potentially related to the use of or association with the club or other golf equipment, or marketing apart from that of the manufacturer, representatives of the manufacturer, and the club or other equipment itself. Furthermore, such configured indicia do not adequately address the expressive needs or desires of the individual consumer, leaving the selection of indicia to that which is limitedly provided by the manufacturer.

Marketing systems, golf marketing systems, and golf equipment such as golf clubs, in particular, have not heretofore met the above identified marketing needs or provided the level of customization or configuration potentially desired by the individual consumer in a golf device. Further, such systems and equipment have not heretofore met the identified needs for affecting or enhancing the performance of the participant, or inducing enhancement, particularly addressing the individual's psychologic or physiologic state, and especially during the performance of a sport such as golf, as previously described.

SUMMARY OF THE INVENTION

The present invention provides systems that address the inadequacies that may have existed with prior efforts directed to sport performance enhancement, marketing, and equipment customization and configuration. The present invention may be considered in some aspects as a development away from that which was previously known in the art of sport performance, marketing, and equipment customization and configuration. Further, the present invention includes a variety of aspects which may be incorporated in different combinations based upon the application and needs to be addressed.

Accordingly, one object of the present invention is to provide systems and techniques affecting or enhancing the performance of a sports participant. One corresponding goal of the present invention is to provide systems and techniques particularly addressing the individual's psychologic or physiologic state, especially during the performance of a sport such as golf. Another goal is to provide systems and techniques that induce a response that affects or enhances performance, especially prior to or during play.

A second object of the present invention is to provide systems and techniques providing indicia to designate goods, sources or services. One corresponding goal of the present invention is to provided systems and techniques having indicia related to the use of or association with the club or other golf equipment. A second corresponding goal is to provide systems and techniques having indicia designating marketing apart from that of the manufacturer, representatives of the manufacturer, and the club or other equipment itself.

Furthermore, an object of the present invention is to provide systems and techniques addressing the expressive needs or desires of the individual consumer. One corresponding goal, therefore, is to provide systems and techniques having indicia or configuration that may be appropriately customized and expressive.

Another object of the present invention is to provide systems and techniques addressing sensory stimulation of an individual. One corresponding goal, therefore, is to provide systems and techniques having indicia or configuration that may be appropriately sensory stimulating for the individual.

A further object of the invention is to utilize what is known about color psychology and the effect of color on mood and emotion and apply this knowledge to the field of sports performance. One goal in keeping with such objective is to help the consumer achieve a response, and in some instances a psychologic or physiologic response, such as a Pavlovian-type response, in the performance of sports wherein the participant's psychologic and physiologic state may ultimately affect the participant's performance and the outcome of the athletic event.

Other broad objects of the invention include: giving the individual consumer an opportunity to use the present invention as a vehicle for self-expression; utilizing the present invention as a vehicle to promote brand awareness; provide services to help consumers make configuration determinations and purchases based on immediate and/or past criteria, potentially, but not limited to internet embodiments, employing any or all of the previously described objects, goals, elements, and steps thereof.

Other objectives and goals may be disclosed throughout this application for patent, including the written description, drawings, and claims. In addition, all objectives and goals may apply either in dependent or independent fashion to a variety of other objectives and goals, and in a variety of embodiments, consistent with the present disclosure.

Accordingly, the present invention provides systems and techniques such as sport systems, marketing systems, equipment, and equipment configuration systems, incorporating in some embodiments, custom expressive indicia and sensory stimulation configurations. Other embodiments may be disclosed throughout this application for patent, including those embodiments disclosed in the written description, drawings, and claims.

BRIEF DESCRIPTION OF THE DRAWINGS

This application for patent or patent contains at least one drawing or photograph executed or otherwise provided in color. Copies of this patent or patent application publication with color drawing(s) or photograph(s) will be provided by the U.S. Patent and Trademark Office upon specific request and payment of the necessary fee.

DETAILED DESCRIPTION OF PREFERRED EMBODIMENTS

Figure 1:
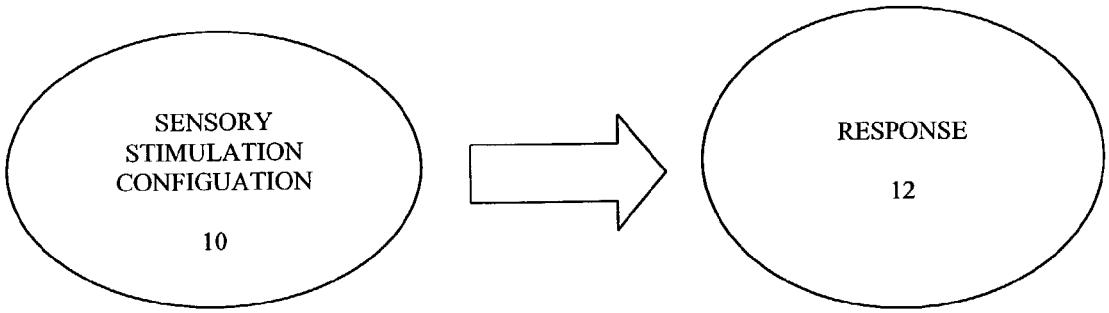
FIG. 1 is a graphic representation of a sensory stimulation configuration and a response in accordance with the present invention.

The features of the present invention may be provided in many different embodiments and may be variously combined in each embodiment. Each of these features may be discussed separately, but each feature may also be combined with other disclosed features. While one preferred embodiment of the invention may be directed, for example, to embodiments incorporating indicia features and corresponding steps, or to embodiments incorporating configuration features and corresponding steps, the broad concepts should be construed as a disclosure of each feature and step or a combination of features and steps, and further to various fields of endeavor and applications. Further, while method, apparatus, and device are disclosed in plurality, it should be understood that each of these may be varied and described in combination, consistent with this disclosure. Also, while each feature and step may apply to various fields of endeavor and applications, as previously mentioned, such indication of applicability should not be construed as indicative of what may be determined to be within the prior art.

As shown in the various figures, embodiments of the present invention provide the ability to affect sport performance, to induce a psychological response in sports, to provide performance enhancement in sports, sports equipment, to provide for the performance of a sport, and other features that overcome many of the disadvantages of past efforts while addressing many of the identified but heretofore unresolved or inadequately resolved needs previously identified.

Generally, embodiments of the present invention provide sensory stimulation configurations to induce a response from an individual, and in some embodiments affect or enhance the individual's performance, where the individual in preferred embodiments is participating in an activity such as a sport or otherwise some athletic activity or game, such that an effect, a performance, a performance enhancement, an affecting, or otherwise provision for the activity may occur, as further described below. The sensory stimulation configuration or configurations may be provided by configuring sports equipment, and in preferred embodiments golf clubs (such as putters, drivers, woods, irons, wedges, utility clubs, rescue clubs, and the like), as further described below, or by the provision of such configured sports equipment. The individual, therefore, responds to the sensory stimulation configurations, as further described below, to accomplish the previously mentioned effect, performance, performance enhancement, affecting, or provision.

Accordingly, the sensory stimulation configuration may induce a response, and in some embodiments, a psychological response, a physiological response, or a combination of such responses. Further, the psychological response may be manifested as an emotion, a mood, a calming effect (as further described below) or other psychological profile, status, condition or otherwise effect. This psychological effect may further translate into a physiologic response, such as the relaxation of muscles or other physiological profile, status, condition or otherwise effect, and may even include physiologic effects that are biochemically attributable or other related responses. Again, and as previously mentioned, the response may also be a physiological effect.

The relationship of the sensory stimulation configuration and the response may be described as provided in FIG. 1. FIG. 1 provides generally for a relationship of the sensory stimulation configuration 10 and an individual's response 12, provided by inducement or stimulus 14. Therefore, the response may be considered to be corresponding to the sensory stimulation configuration, as further described below. In some embodiments, the response may be considered psychologic, physiologic, or a combination thereof. However, other responses may be possible in accordance with some embodiments. Further, the sensory stimulation configuration and response relationship may be considered in some embodiments to exhibit cause and effect type relationships.

Specifically, and with regard to the relationship depicted in FIG. 1, the inducement or stimulus and the response through the sensory stimulation configuration may be accomplished, in some embodiments, through a form of reinforcement schedule, potentially by a psychologic or physiologic response, that may condition the body of the individual into a conditioned response, such as a reflexive response.

Further, embodiments of the present invention can also help induce or otherwise generate a pavlovian type response such as in sports where consistent body mechanics may be crucial. Using golf as but one example, ideally, one would hit all of their clubs using the same swing. As different distances are required, the club changes, but the swing should remain consistent. The driver and other woods are often used at the tee box to make the longest shots and therefore it is the tendency of most players to try to hit the ball harder and therefore disrupt and usually change the mechanics of the swing they have spent hours practicing. By using a sensory stimulation configuration to induce or otherwise generate a response, as with Pavlov's dogs salivating at the sound of a bell that was rung only at feeding time, a response 12 may be induced repeatedly, associating a specific response, such as the swing of a golf club, with a specific sensory stimulation configuration 10. Again, relative to the performance of a sport, athletic event, game, or other like activity, such as golf, the individual may be able to train or otherwise focus on a sensory stimulation configuration, such as at least one color or image, including at least one business designation, to produce a more correct swing, and therefore a more consistent and accurate swing.

The sensory stimulation configuration may be provided as at least one color, at least one image, or a combination thereof, including, in some embodiments, that which may be considered at least one business designation, such as a trademark or trade dress, potentially for use in brand recognition. The sensory stimulation configuration may also be provided as indicia, and in some embodiments custom expressive indicia, as further described below. Therefore the sports equipment may be configured with such indicia.

In some preferred embodiments, the sensory stimulation configuration may be provided as at least one color, image, or business designation, or a combination thereof, examples of which are configured sports equipment, or portions of configured sports equipment, such as configured golf clubs, or portions of golf clubs, as in the golf clubs of FIGS. 2A through 2G. The club head in each of these embodiments is configured with the sensory stimulation configuration. The sensory stimulation configuration may be configured to the equipment, in some embodiments, in accordance with the configuration techniques further described below. The sports equipment, in preferred embodiments, may comprise a sensory stimulation configuration of at least a portion of the sports equipment, such that the sensory stimulation configuration is configured to induce a response from the individual and affect the individual's performance corresponding to the response.

Further, a sport may thus be performed in accordance with the present invention, such that sports equipment configured with a sensory stimulation configuration is utilized and the individual responds to the sensory stimulation configuration, such that an action of the sport may be performed, such as swinging a golf club, corresponding to the response. Golf, as but one example, may be performed as previously described. Other sports could be performed in a similar fashion in accordance with the present invention.

In preferred embodiments, the sports equipment configured with the sensory stimulation configuration may be utilized such that the response is induced during the utilization of the equipment. For example, a golfer may view the sensory stimulation configuration, provided as the configured golf club, during the swing and impact with the ball such that the response is induced. This inducement of the response or the affecting of performance may occur during performance of the sport, as just previously described in relation to preferred embodiments directed to golf and the swing of the golf club.

Figure 2:
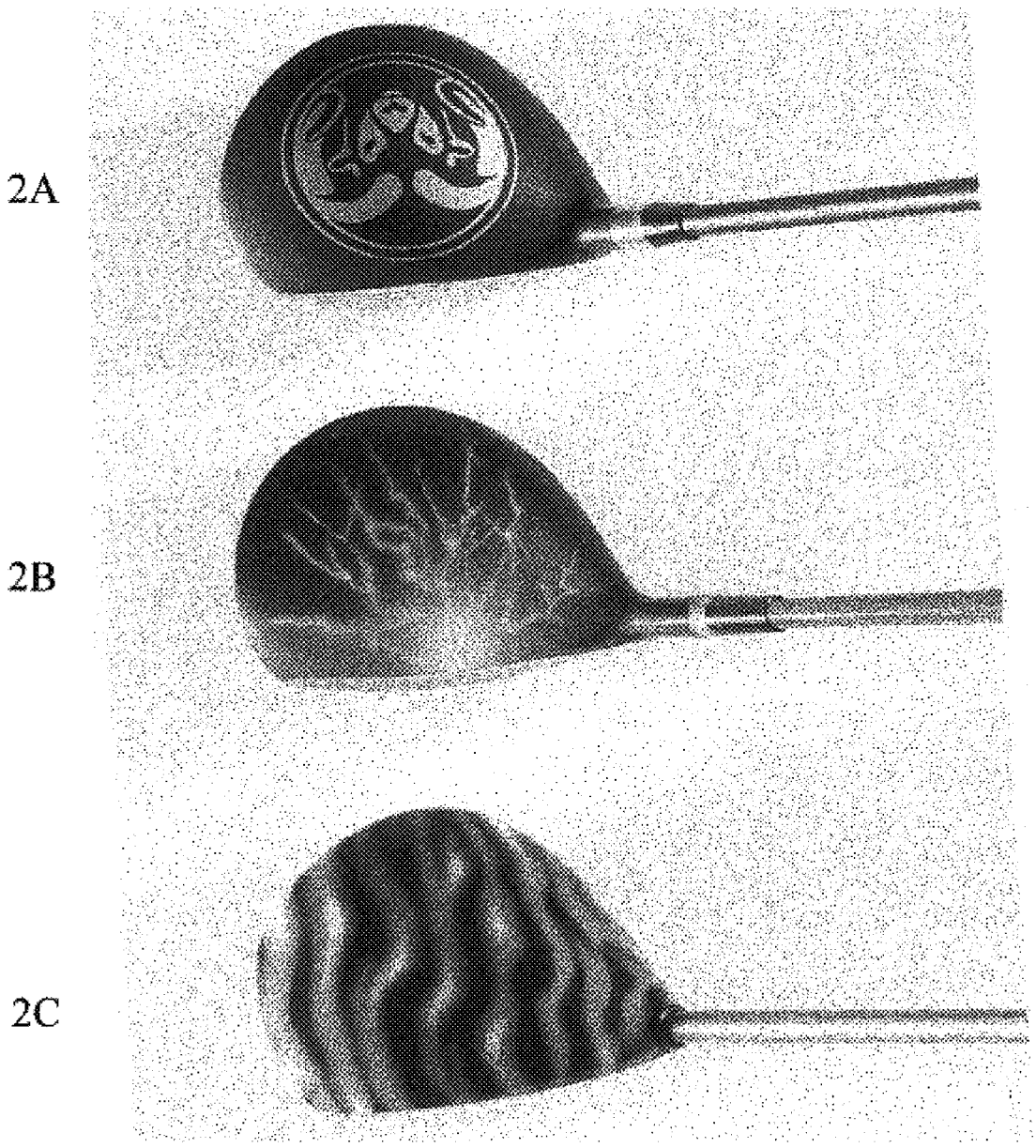
FIGS. 2A-2G are photographs of golf clubs configured in acordance with embodiments of the present invention, and further exemplifying a product of one customization embodiment also of the present invention.
Figure 2:
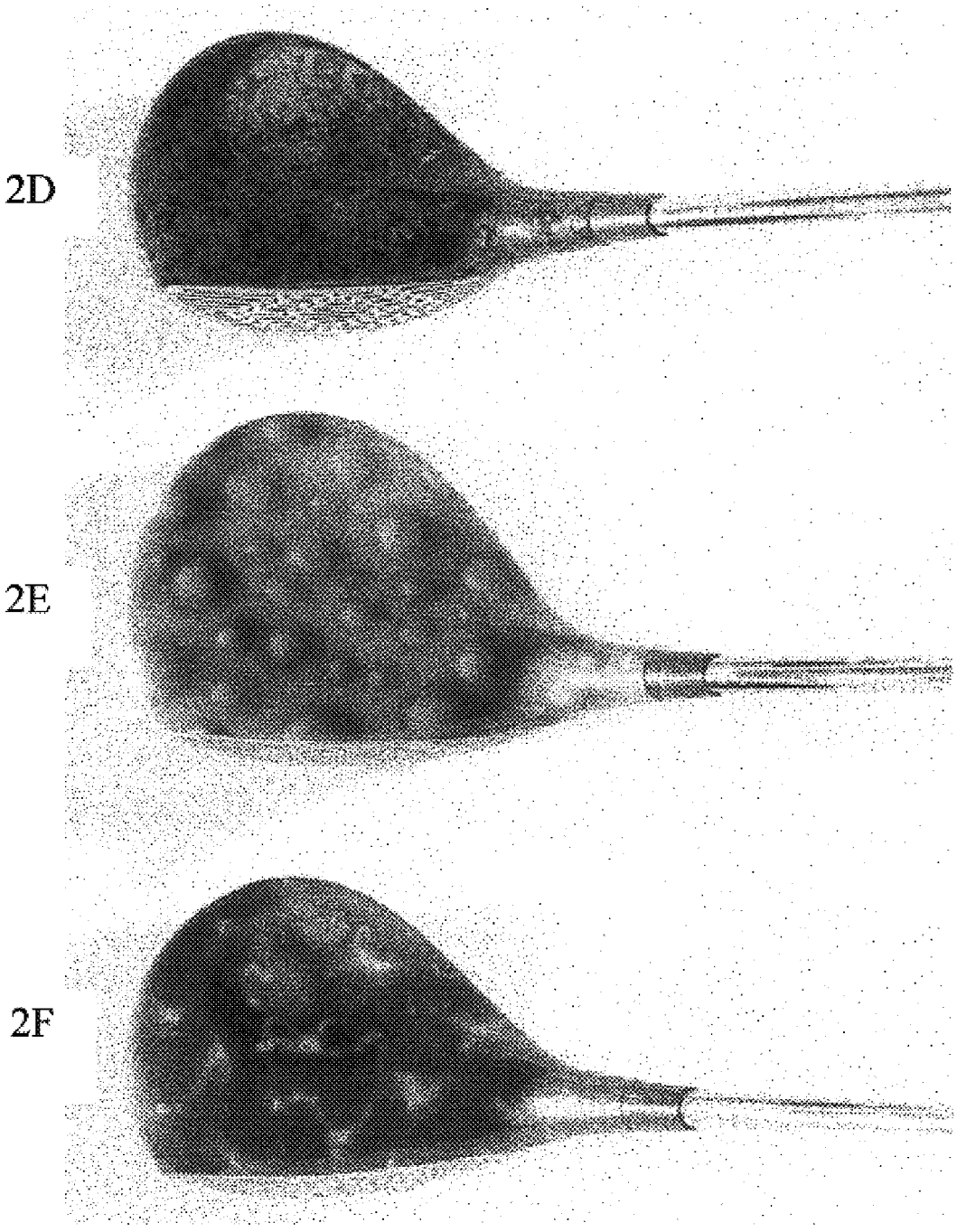
Figure 2:
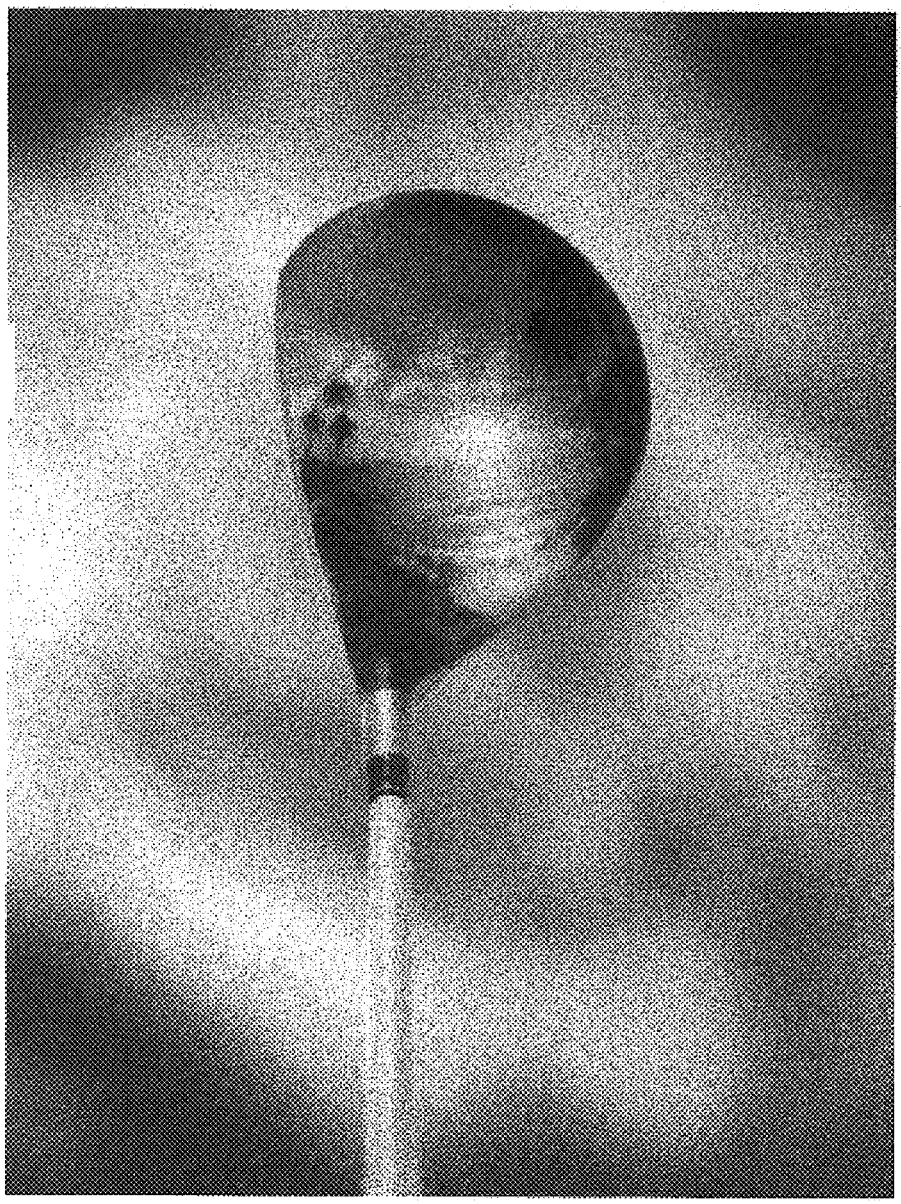
Figure 3:
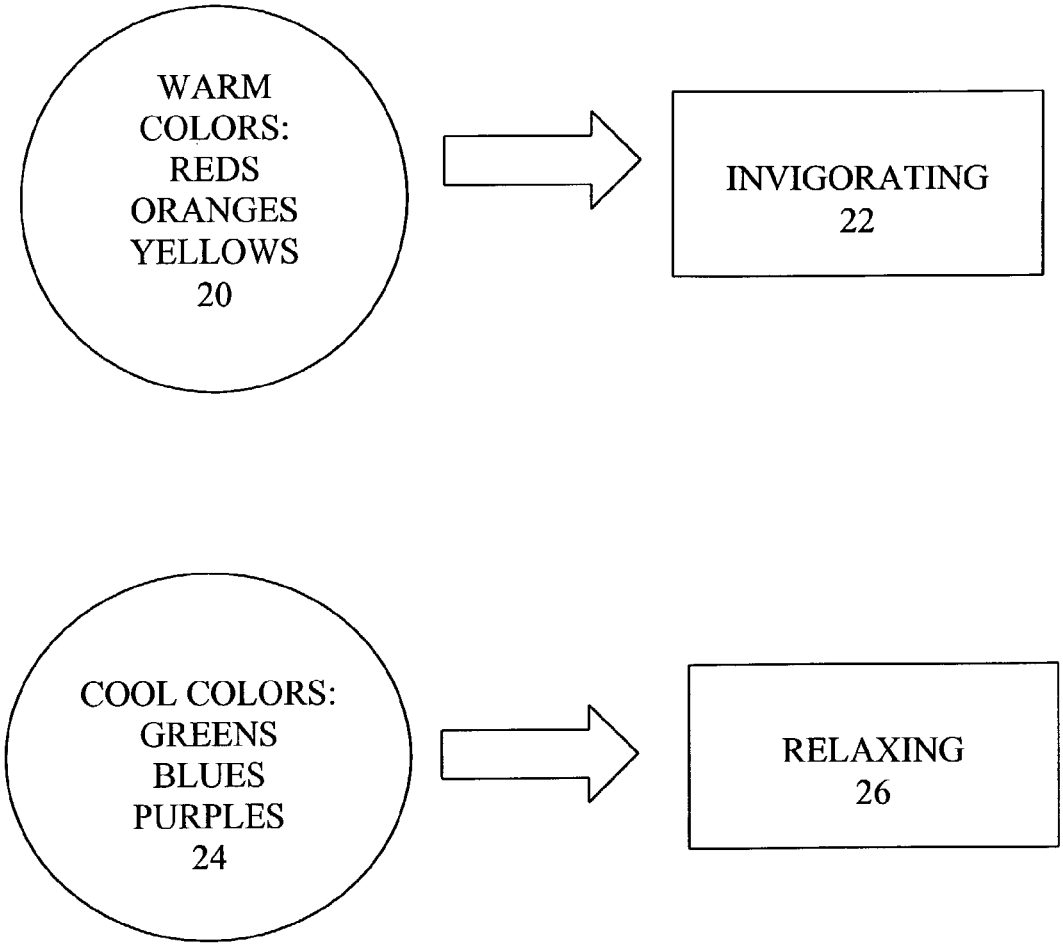
FIG. 3 is a graphic representation of responses in accordance with the present invention.

As previously mentioned, the sensory stimulation configuration are provided to induce or otherwise generate a response, as previously described, that may effect the performance, enhance the performance, provide for the affecting of the performance, or provide for the performance of a sport or an activity thereof. The sensory stimulation configuration may even be provided as configured sport equipment in accordance with the present invention, as in the embodiments shown in FIGS. 2A through 2G. In some preferred embodiments, and as shown in FIG. 3, different colors may evoke different psychological responses. Warm colors 20, such as reds, oranges and yellows, are utilized to induce, for example, an invigorating response 22, while cool colors 24, such as greens, blues and purples, are utilized to induce a relaxing response 26. Using golf as but one example, the psychological or physiological state of the player may have an appreciatable impact on that player's level of performance. The individual usually must stay focused and relaxed under pressure, perhaps even mentally overriding certain physical or psychological responses. A typical tendency for golfers, by attempting to hit a golf ball a relatively great distance, is to grip the club firmly and swing the club at the ball as hard as possible. It may, however, be preferable for the golfer to relax, grip the club loosely, and take a relaxed and full swing, in order to achieve greater distances. Therefore, the performance of an individual in a sport, such as golf, may be enhanced by the sensory stimulation configuration.

Further, in some embodiments, a psychological response may be followed by a physiologic response. In other embodiments, an initially psychologic response may be followed by a physiologic response. The combination and occurrence of the response will be determined by the particular sensory stimulation configuration and the sensory system of the individual, as may be potentially determined by the psychological or physiological make up of the individual.

It is of particular notice that the present invention, and particularly that of the sensory stimulation configuration, need not be apparently associated with structural function of the sports equipment. In some embodiments, the sensory stimulation configuration may even be configured such that it is unapparently associated with structural function of the sports equipment, contrary to such markings and other indicators such as ball aligning marks or other apparently, structurally functional configurations. The sensory stimulation configuration, however, in accordance with some embodiments of the present invention, may actually have indirect, latent, or otherwise unapparent association with structural function. Therefore, performance enhancement may be provided by configuring sports equipment with a sensory stimulation configuration, unapparently associated with structural function of the sports equipment, inducing a response from an individual corresponding to the sensory stimulation configuration, and enhancing the performance of said individual corresponding to said response.

Embodiments of this invention may also lend themselves to being used for the purpose of self-expression. In using any or all of the aspects of the present invention, one could easily use at least one color or image, such as a design or scene, that may or may not feature a sensory stimulation configuration aspect, as previously described, but one that was pleasing to the individual or some type of at least one color or image with which the individual had positive psychological associations, thus inducing or otherwise generating a response, such as a psychological response.

It should be understood that the term sensory stimulation is understood in accordance with the present disclosure to mean the initiation or characteristic of one or a plurality of stimulus to one or more senses or sensory systems of an individual. Such stimulus may broadly include sound, feel, odor, flavor, or perception, or a combination thereof, relative to senses or sensory systems such as hearing, touch, smell or olfactory senses, taste and vision, all in accordance with the present invention. In preferred embodiments, such sensory stimulation may be especially related to visual stimulation, as previously described.

Embodiments of the invention may further provide marketing systems, golf marketing systems, and sports equipment, such as golf clubs, configured for marketing or otherwise, and other features that overcome many of the disadvantages of past efforts while addressing many of the identified but heretofore unresolved or inadequately resolved needs previously identified.

In overcoming such unresolved needs, configurations of sports equipment, such as golf clubs (such as putters, drivers, woods, irons, wedges, utility clubs, rescue clubs, and the like), may be provided with configuration that is indicative of goods or services, such as business designation, or otherwise indicia. In some embodiments of the present invention, the indicia is custom expressive.

The term custom may be considered an option, choice or otherwise an election that is apart from that which is provided to an entire populous or group, such as consumers. The option, choice, or otherwise election may be directed to a specific group, and in some embodiments, a specific individual or business, apart from option, choice or otherwise election provided to the general market of consumers. The custom aspect may, in some embodiments, comprise a preference of the specific group, individual, or business. Further, the term expressive, in accordance with some embodiments of the present invention, may be considered representative of the indicia, such as at least one color, at least one image, at least one business designation, or the like, such as trademark or trade dress, that represents the custom preference, and potentially indicative of stimulus, designation, or creative design.

In some embodiments, such custom expressive indicia may be unapparently associated with structural function of the corresponding sports equipment, contrary to such markings and other indicators such as ball aligning marks or other apparently, structurally functional configurations. The custom expressive indicia, however, in accordance with some embodiments of the present invention, may actually have indirect, latent, or otherwise unapparent association with structural function.

Accordingly, embodiments of the present invention provide marketing systems, golf marketing systems, and sports equipment configurations, such as golf club configurations, or other features and embodiments as previously described, having a configuration or configurations comprising custom expressive indicia. In some embodiments, such custom expressive indicia may be the sensory stimulation configuration as previously described, and therefore capable of inducing or otherwise generating a response as previously described. Therefore, sports equipment, and in preferred embodiments golf clubs, may be configured with custom expressive indicia. Marketing, or other forms business activity, therefore, may be accomplished in accordance with the present invention.

The configured indicia, such as the custom expressive indicia, may be used for the purpose of brand recognition, marketing, or other form of business activity. Sports equipment, such as golf clubs, can be configured, such as through painting, for the purpose of creating public awareness; promotion and/or advertising using indicia, such as at least one color, image, or business designation. As previously mentioned, the custom expressive indicia may correspond with or otherwise comprise sensory stimulation configuration, which, in some embodiments, may provide a positive psychological benefit, such as a response, for the user of the equipment, but that further serves as indicia in accordance with the present invention. Such configuration may create a positive situation for the group, individual, or business to which the indicia is customized and for which the indicia is expressive, while providing the benefits of sensory stimulation configuration.

Custom expressive indicia may comprise, but are not limited to, logo's, collegiate or professional sports logos, trademark or trade dress, and special event promotions. An example of such custom expressive indicia is shown in FIG. 2A, for example, comprising custom expressive indicia of a college, Colorado State University™, configured to the club head of a golf club. The other FIGS. 2B through 2G may further described custom expressive indicia, in accordance with some embodiments of the present invention.

As previously mentioned marketing and other business activity may be conducted incorporating such custom expressive indicia. As such, the custom expressive indicia may be considered custom expressive marketing indicia, in some embodiments. The indicia may be customized to golf services, and in some embodiments, golf services associated with the sports equipment, such as the golf device to which the indicia is configured. In other embodiments, the indicia may be customized to golf products, and in some embodiments, golf products associated with the sports equipment, such as the golf device. Examples of such customization may include custom expressive indicia indicative of pro golf shops, golf pros, manufacturers, or retailers. In some embodiments, the indicia may be customized to the sports equipment, such as the golf club, itself.

However, the custom expressive indicia need not be indicative of golf services or products, and may be custom expressive indicia indicative of other groups, businesses, or individuals apart from the sports equipment or services, or even apart from sport or athletic goods or services generally. For example, one embodiment might include custom expressive indicia indicative of a real estate company, and the custom expressive indicia could be configured to a golf club, as shown in the FIGS. 2A through 2G.

As previously mentioned, the custom expressive indicia may be customized to an individual, to at least one business, and to at least one group. The group, in some embodiments, may be at least one college, at least one alumni organization, at least one business group, at least one fraternal organization, at least one non-profit organization, at least one group of individuals, or at least one group of entities.

In accordance with the present invention, indicia may be provided, and in preferred embodiments custom expressive indicia, as at least one color, at least one image, or as at least one business designation, such as trademark or trade dress, or a combination thereof, and in some embodiments, further customized to an individual, group or business as previously described.

Figure 4:
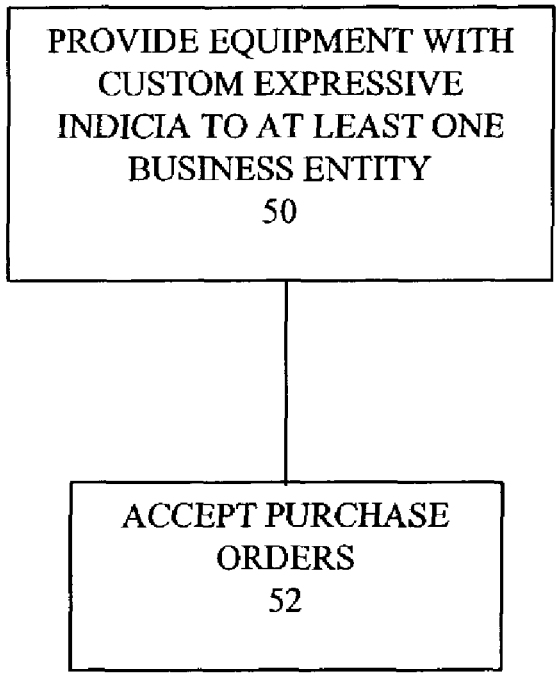
FIG. 4 is a flow chart of one embodiment of the present invention.

Marketing and other business activity may be performed incorporating custom expressive indicia, as shown in FIG. 4. One embodiment of marketing in accordance with the techniques of the present invention incorporates the provision of equipment (50), such as at least one golf device, configured with the custom expressive indicia, to at least one business entity, such as at least one retail store, pro shop, wholesale store, distributor, or other such business. In some embodiments, the equipment may be provided through internet supply channels. The business entity may further provide business activity relative to the equipment and the custom expressive indicia. Accordingly, a display may be provided comprising the equipment, and in preferred embodiments the golf club or a portion thereof, to display the equipment and the custom expressive indicia. The custom expressive indicia may be custom expressive to the business entity, customers or other business relations of the business entity, or may be custom expressive to some other individual, business or group. Purchase orders may then be accepted (52), potentially through the internet, such as a website, either by the business entity or by the supplier of the equipment configured with the custom expressive indicia, for sports equipment, such as golf clubs, configured with custom expressive indicia. The purchase order need not request equipment identical or substantially similar to the equipment provided to the business entity. The purchase order could include an order for the equipment itself, an order for the custom expressive indicia, an order for the customization or configuration of the equipment, as further described below, or a combination thereof. The purchase order may identify a desirable custom expressive indicia to be configured to the sports equipment, or may request a determination of such indicia, as further described below.

Other marketing or other business activity may be performed in accordance with the present invention. For example, the custom expressive indicia may be utilized for brand recognition, such as through usage as trademark or trade dress. Such usage of the custom expressive indicia may provide for brand recognition or other trademark or trade dress usage by the business entity to which the equipment has been provided, as previously described. These examples and other marketing and other business activity are embodiments of the present invention.

Figure 5:
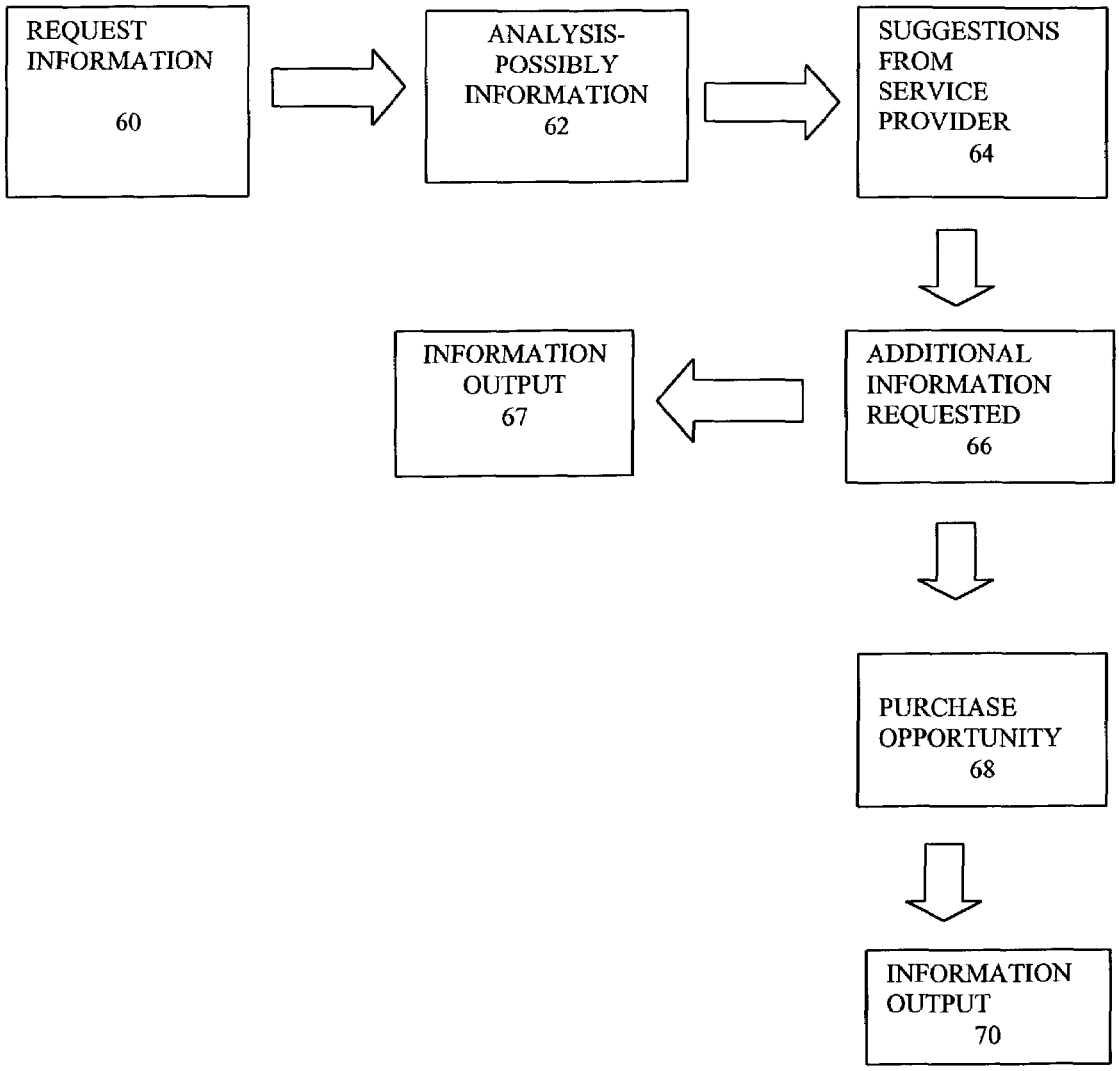
FIG. 5 is a flow chart of another embodiment of the present invention.

The determination and selection of the custom expressive indicia, or that of the sensory stimulation configuration, may be provided to help individuals, consumers, businesses, groups, and others, as previously described, make determinations, potentially based on immediate and/or past criteria. In some embodiments, the indicia or configuration can be customized to the individuals, consumers, businesses, groups. Determination, selection, or customization may be provided in an embodiment as shown in FIG. 5, and in some embodiments via the internet, and as further described below. In other embodiments, the custom expressive indicia or the sensory stimulation configuration may be predetermined, potentially by the individual, consumer, business, or group. In alternative embodiments, a provider of the equipment configured with the indicia or configuration may have predetermined criteria based upon the individual, consumer, business, or group to provide an appropriate indicia or configuration.

In one embodiment, a service provider may request information 60 about the individual, group, business, consumer, or customer. Such information may include, in some embodiments with regard to sensory stimulation configuration, a listing of the relevant participated sport or sports, what problems are encounter during competition, and other information, such as an optimal response, a sport performance characteristic, a personality characteristic, an optimal psychological response, or other information, potentially requested through questions, to assist in or determine a sensory stimulation configuration, potentially represented as a profile, such as a psychological profile. In other embodiments, information may be requested relative to a custom expressive indicia, such as information regarding trademark or trade dress. In additional embodiments, the indicia or configuration may be provided by the individual, group, business, consumer, or customer.

The information, and in some embodiments the profile, may be analyzed 62 to make the determination. The service provider might provide suggestions 64 regarding configuration, such as color choices, trademark usage, or other advice that the individual, group, business, consumer, or customer might find helpful. Additional information may also be requested 66, perhaps historical sport performance or sales input, to create a more complete determination. This exchange of information could be repeated until the individual, group, business, consumer, or customer had the desired information and might be followed by a purchase opportunity 68. In some embodiments, opportunities for purchases would not require the previously described determination. In some embodiments, the individual, group, business, consumer, or customer may obtain the results of the determination.

An individual, group, business, consumer, or customer may even determine their response, in some embodiments predetermine the response, such as an optimal response relative to a configuration, based on such aspects such as personality, sport, and history of performance, performance problems, and other relevant information, to determine the sensory stimulation configuration, such as at least one color or image, including business designation, or a combination thereof that is desirable. The determination could also include determinations regarding custom expressive indicia, such as preferred colors, images, including trademark or trade dress. In some embodiments, information may be output 67, 70 to the individual, group, business, consumer, or customer, which may include information regarding purchase, information regarding analysis 62, including, in some embodiment, a profile. The profile may include various psychological responses to certain sensory stimulation configurations or may include recommendations regarding utilization of indicia. If after receiving the different psychological responses an individual, group, business, consumer, or customer is still unsure of their needs they may be able to get further input previously described and shown in FIG. 5.

Further, and in some embodiments combined with the previous features of determination and customization, the sensory stimulation configuration or the custom expressive indicia may be generated, either by the individual, group, business, consumer, or customer or the service provider. The generation may include the generation of at least one color, at least one image, at least one business designation, indicia corresponding to an individual's optimal psychologic response, indicia corresponding to at least one personality characteristic, or indicia corresponding to at least one sport performance characteristic.

Figure 6:
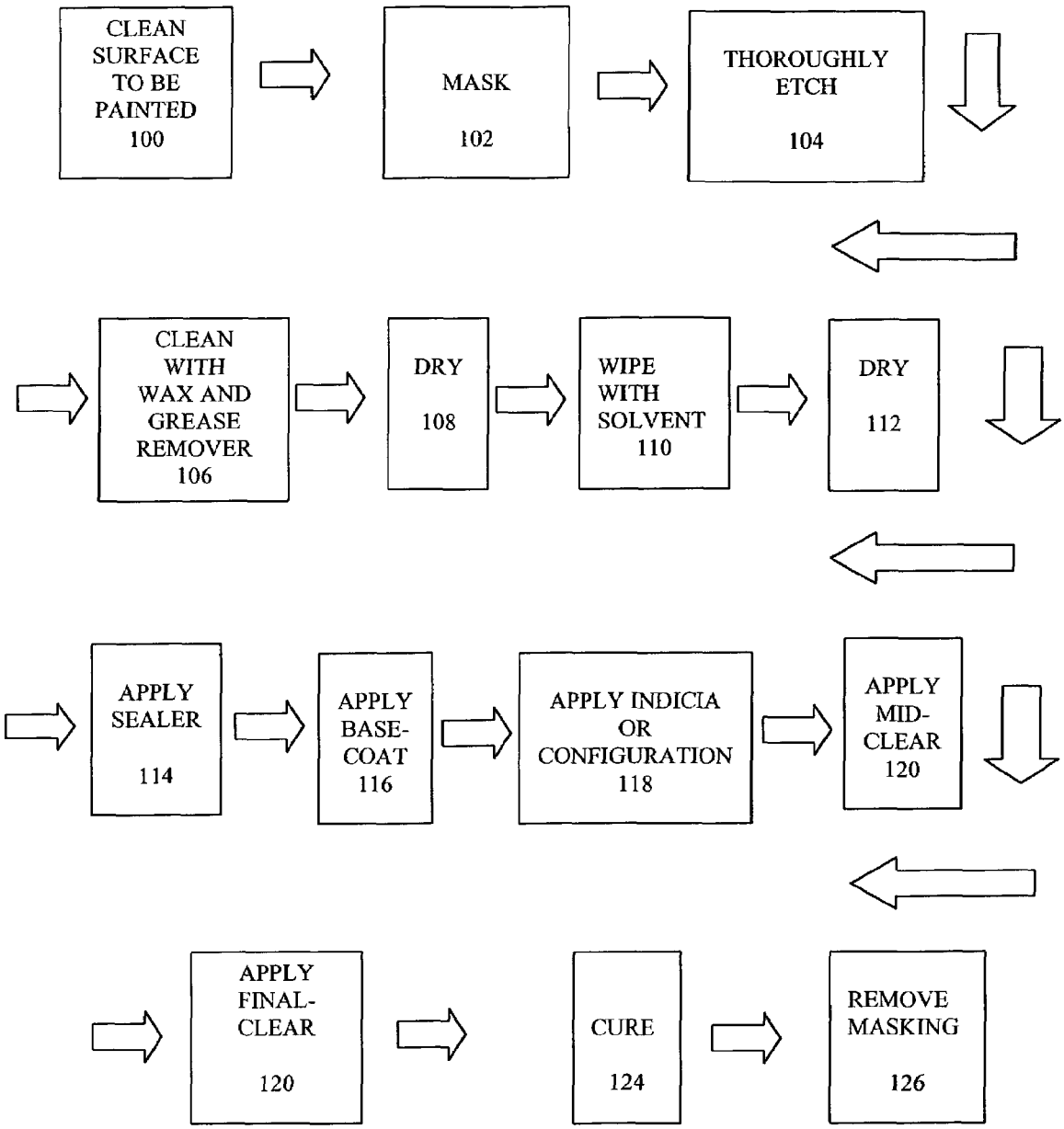
FIG. 6 is a flow chart of a customization embodiment of the present invention.

As shown in FIG. 6, one embodiment of the invention may provide customization of sport equipment, such as a golf device, and in preferred embodiments a golf club. The customization preferably involves painting techniques to provide indicia or configuration in accordance with the present invention. Generation of the indicia or configuration may be provided as previously described.

One embodiment of the customization process is shown in FIG. 6 and can be described through the following technique:

clean the surface to be painted (100); mask off areas not to be painted (102); thoroughly etch unmasked area (104); clean paintable area, in some embodiments with wax and grease remover (106); air-dry, and in some embodiments to 70 degrees minimum (108); wipe paintable area with final clean solvent (110); air-dry, in some embodiments 70 degrees minimum (112); apply sealer, in some embodiments Valueshade or equivalent type sealer, potentially automotive or similar grade, one coat with HVLP gravity feed gun 30-35 PSI @ the gun 6 to 9 PSI at gun cap, air dry 25 minutes before topcoat of base color (114); apply base coat, in some embodiments a base color, automotive grade, perhaps mixed 1 to 1 ratio with reactive reducer (the pot life may be 8 hours at 72 degrees; base coat may be exposed for 72 hours prior to clear urethane application; beyond that period, use of bonding clear may be applied prior to final clear) (116); apply the indicia or configuration (118), in some embodiments, the indicia or configuration will be generated, potentially through various mediums including digital decals, vinyl masks, airbrushed custom images, and various custom painting techniques and potentially using automotive grade or equivalent type paints (base color and airbrush colors may be reduced in ratio of 100% to 200%); apply mid-clear coat may be applied over indicia or configuration for protection (120); apply final clear coat, in some embodiments consisting of catalyzed urethane or equivalent with anti-scuff product mixed thoroughly may be applied at 45-50 PSI @ gun and 12-14 PSI @ gun cap (one coat only may be applied) (122); cure, in some embodiments at 120 degrees ambient temperature for 30 minutes (124); remove masking (126).

Choice of paint used for this process may be important in some embodiments. To achieve the desired affects and produce a product that is durable, scuff resistant and scratch resistant, automotive grade or equivalent type paints can be used along with additives to increase "flex" in the paint to reduce chipping and cracking especially when used in applications where the painted article may endure strong impact, such as golf. Adequate surface preparation may also be important for the paint to properly adhere to the article. Examples of golf clubs painted using variations of this technique are shown in FIGS. 2A through 2G.

As can be easily understood from the foregoing, the basic concepts of the present invention may be embodied in a variety of ways. It involves both method and process as well as apparatus and device. In this application, embodiments may be disclosed as part of the results shown to be achieved by the various plurality of apparatus and device described and as steps which are inherent to utilization. They are simply the natural result of utilizing the plurality of apparatus and device as intended and described. In addition, while a plurality of apparatus and device are disclosed, it should be understood that these not only accomplish certain methods and processes but also can be varied in a number of ways. Importantly, as to all of the foregoing, all of these facets should be understood to be encompassed by this disclosure.

It should also be understood that a variety of changes may be made without departing from the essence of the invention. Such changes are also implicitly included in the description. They still fall within the scope of this invention. A broad disclosure encompassing both the explicit embodiment(s)

shown, the great variety of implicit alternative embodiments, and the broad methods or processes and the like are encompassed by this disclosure.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each element disclosed should be understood to encompass a disclosure of the action which that element facilitates. Regarding this last aspect, as but one example, the disclosure of "configuration" should be understood to encompass disclosure of the act of "configuring"—whether explicitly discussed or not—and, conversely, were there effectively disclosure of the act of "configuring", such a disclosure should be understood to encompass disclosure of "configuration" and even a "means for configuring". Such changes and alternative terms are to be understood to be explicitly included in the description.

Any acts of law, statutes, regulations, or rules mentioned in this application for patent, and any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition and are hereby incorporated by reference. Finally, all references listed in the list of References To Be Incorporated By Reference In Accordance With The Provisional Patent Application or other information statement filed with the application are hereby appended and hereby incorporated by reference; however, as to each of the above, to the extent that such information or statements incorporated by reference might be considered inconsistent with the patenting of this/these invention(s) such statements are expressly not to be considered as made by the applicant(s).

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

The claims set forth in this application are hereby incorporated by reference as part of the description of the invention, and the applicant expressly reserves the right to use all of or a portion of such incorporated content of such claims as additional description to support any of or all of the claims or any element or component thereof. The Applicant's further expressly reserves the right to move any portion of or all of the incorporated content of such claims or any element or component thereof from the description into the claims or from the claims into the description as necessary to further define the matter for which protection is sought by this application or by any subsequent continuing application thereof, or to obtain any benefit of, reduction in fees pursuant to, or to comply with the patent laws, rules, or regulations of any country or treaty, and such content incorporated by reference shall survive during the entire pendency of this application including any subsequent continuing application thereof or any reissue or extension thereon.

We claim:

1. A method of marketing, comprising the steps of:

requesting individual information through questions to ascertain an individual characteristic selected from the group consisting of at least one personality characteristic, at least one sport performance characteristic, and at least one psychologic response;

analyzing said individual information to assist an individual to determine custom expressive indicia related to said individual characteristic;

configuring at least one golf device with said custom expressive indicia; and marketing with said custom expressive indicia, wherein said step of analyzing comprises the step of analyzing an individual's psychological profile.

2. A method of marketing as described in claim 1, wherein said step of configuring comprises customizing said custom expressive indicia to induce psychological response.

3. A method of marketing as described in claim 1, wherein said step of configuring comprises customizing said custom expressive indicia with at least one color.

4. A method of marketing as described in claim 1, wherein said step of configuring comprises customizing said custom expressive indicia to at least one image.

5. A method of marketing as described in claim 3, wherein said step of configuring comprises customizing said custom expressive indicia to induce psychological response.

6. A method of marketing as described in claim 1, wherein said step of configuring comprises configuring with colored indicia.

7. A method of marketing as described in claim 1 further comprising the step of providing suggestions to said individual regarding golf device indicia.

* * * * *